US006361406B1

(12) United States Patent
Ohta

(10) Patent No.: US 6,361,406 B1
(45) Date of Patent: Mar. 26, 2002

(54) ABRASION METHOD OF SEMICONDUCTOR DEVICE

(75) Inventor: Toshiyuki Ohta, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/549,426

(22) Filed: Apr. 13, 2000

(30) Foreign Application Priority Data

Apr. 20, 1999 (JP) ..... 11-111965

(51) Int. Cl.[7] ..... B24B 1/00

(52) U.S. Cl. ..... 451/41; 457/5; 457/6; 457/10

(58) Field of Search ..... 451/5, 41, 6, 10, 451/285–289; 438/697, 693; 156/345

(56) References Cited

U.S. PATENT DOCUMENTS 5,643,050 A * 7/1997 Chen ..... 451/10
5,730,642 A * 3/1998 Sandhu et al. ..... 451/6
5,948,203 A * 9/1999 Wang ..... 156/345
6,120,347 A * 9/2000 Sandhu et al. ..... 451/5
6,132,289 A * 10/2000 Labunsky et al. ..... 451/6
6,146,248 A * 11/2000 Jairath et al. ..... 451/41

FOREIGN PATENT DOCUMENTS

JP 9-8038 1/1997

* cited by examiner

*Primary Examiner*—George Nguyen
(74) *Attorney, Agent, or Firm*—Scully, Scott Murphy & Presser

(57) ABSTRACT

In an abrasion method of a semiconductor device, in which concavity and convexity of an oxidized film surface on a wafer 13 are abraded using an abrasive pad 11, a region to be simulated in a layout data of a wiring process of the semiconductor device is divided into a plurality of small regions (i,j), and approximate average height H(i,j) of the abrasive pad 11 from a concave pattern 14 in the small regions (i,j) is calculated based on a sum total B of areas of tip surfaces of convex patterns, average height h(i,j) of the convex patterns 12, and a sum total C of an area of a surrounding region P around each convex pattern 12.

8 Claims, 3 Drawing Sheets

ABRASION METHOD OF SEMICONDUCTOR DEVICE

BACKGROUND OF THE INVENTION

The present invention relates to an abrasion method of a semiconductor device, and especially, to an abrasion method of a semiconductor device using a Chemical Mechanical Polishing (CMP) technique.

A conventional abrasion method of a semiconductor device using the CMP is described in JP-A-8038/1997. FIG. 3A and FIG. 3B are views illustratively showing an abrasion method described in this publication, and FIG. 3A is a plain view of one small region, and FIG. 3B is a cross sectional view along a b—b line of FIG. 3A.

In the above-described conventional abrasion method, for abrading steps of an oxidized film formed on wiring of aluminum and so forth on a wafer 13, first as shown in FIG. 3A, a region to be simulated of a layout data is divided into a plurality of rectangular small regions. Further, when a sum total of tip areas of a plurality of convex patterns 12 corresponding to a convex shape of the wiring of the same small region is B, an area of a small region (i,j) which is the i-th in an x direction and the j-th in a y direction in dividing the region to be simulated into a matrix is A, density (=B/A) of the convex patterns 12 in the small region (i,j) is d(i,j), a gradient of an abrasive pad is g(i,j), and a proportional constant is r0, a movement rate (refer to an abrasion rate also, hereinafter) r(i,j) of the abrasive pad in abrasion of the small region (i,j) is calculated by the following equation:

$$r(i,j)=r0\cdot g(i,j)/d(i,j).$$

Here, when a proportional constant is c, and height of the convex patterns 12 is h(i,J), assuming that there are four convex patterns 12 around one convex pattern 12, the gradient g(i,j) in the abrasive pad is obtained by the following equation:

$$g(i,j)=1+c\{4h(i,j)-h(i+1,j)-h(i-1,j)-h(i,j+1)-h(i,j-1)\}.$$

Thereby, a step on the wafer 13 is predicted.

By the way, in case that the density of the convex patterns 12 is high, as shown in FIG. 3B, the abrasive pad 11 is in contact with only tip surfaces of a number of convex patterns 12 without bending so much, and is not in contact with a concave pattern 14 around the convex patters. In this case, average stress applied to the plurality of convex patterns 12 is in inverse proportion to the density of the convex patterns 12. In accordance with this, in the conventional abrasion method, an abrasion rate is calculated simply on the assumption that it is in inverse proportion to the density of the convex patterns 12.

However, in case that the density of the convex patterns is low for example, the abrasive pad 11 is also in contact with the concave pattern 14 around the convex patterns 12, and thereby, stress from the abrasive pad acts on the convex patterns 12, and due to this, the abrasion rate generates an error between a measurement value and a simulation value, and a task that an abrasion accuracy is reduced occurs.

SUMMARY OF THE INVENTION

The present invention is made to solve the above-mentioned problems.

Moreover, the objective of the invention is to provide an abrasion method of a semiconductor device, in which, even in case that the density of the convex patterns (convex portions) on the semiconductor substrate is low, an abrasion accuracy can be improved by setting an appropriate abrasion rate.

In order to accomplish the above-described objective, an abrasion method of a semiconductor device of the present invention, in which concavity and convexity of an oxidized film surface on a semiconductor substrate are abraded using an abrasive pad, is characterized in that it includes steps of:

dividing a region to be simulated in a layout data of a wiring process of the above-described semiconductor device into a plurality of small regions; and calculating approximate average height of the above-described abrasive pad from concave portions in the above-described small regions based on a sum total of areas of tip surfaces of the above-described convex portions, average height of the above-described convex portions, and a sum total of an area of a surrounding region around each convex portion.

In the abrasion method of a semiconductor device of the present invention, since the approximate average height of the abrasive pad is newly added as a parameter for calculating an abrasion rate by taking account of a point that whole stress in the surrounding region, which is applied from the abrasive pad, acts on the convex portions, it becomes to be possible to calculate an appropriate abrasion rate, and especially, it is possible to avoid a task that, in case that the density of the convex portions is low, an actual abrasion rate is higher than a rate by means of a simulation, and to improve an abrasion accuracy.

Here, in the preferable abrasion method of a semiconductor device of the present invention, when the sum total of areas of tip surfaces of each convex portion is B, the average height of the above-described convex portions is h(i,j), and the sum total of an area of the above-described surrounding region is C, the approximate average height H(i,j) of the above-described abrasive pad in the small regions (i,j) within the above-described plurality of small regions is obtained by the following equation:

$$H(i,j)=h(i,j)\cdot B/(B+C).$$

In this case, since the approximate average height of the abrasive pad is obtained by the simple equation, it is possible to suppress the increase of calculation time by a computer apparatus and so forth.

Also, it is a preferable form of the present invention to obtain a gradient G(i,j) of the above-described abrasive pad in the above-described surrounding region by means of the following equation when a proportional constant is k:

$$G(i,j)=1+k\{4H(i,j)-H(i+1,j)-H(i-1,j)-H(i,j+1)-H(i,j-1)\}.$$

In this case, since a solution of a difference equation can be used for a calculation part that needs time, it is possible to suppress the increase of calculation time by a computer apparatus and so forth.

Furthermore, it is preferable to obtain effective density D(i,j) of the above-described convex portions, and a movement rate R(i,j) of the above-described abrasive pad by the following equations, respectively, when an area of the above-described small regions (i,j) is A, and a proportional constant is R0:

$$D(i,j)=A/(A+C),$$

and $$R(i,j)=R0\cdot G(i,j)/D(i,j).$$

In this case, it is possible to correctly calculate an abrasion rate, and especially, to effectively prevent a task that there is a difference in an abrasion rate between a measurement value and a simulation value in case that the density of the convex portions is low.

An abrasion method of a semiconductor device of the present invention, in which concavity and convexity of an oxidized film surface on a semiconductor substrate are abraded using an abrasive pad, is characterized in that it includes steps of:

dividing a region to be simulated in a layout data of a wiring process of the above-described semiconductor device into a plurality of small regions;

calculating coordinates of the concavity and convexity of the above-described oxidized film surface based on average height of each convex portion in the above-described small region; and obtaining a movement rate of the above-described abrasive pad based on a stress analysis which is conducted by pressing the above-described abrasive pad against the above-described oxidized film surface, and a value of coordinates of the above-described concavity and convexity.

In the abrasion method of a semiconductor device of the present invention, it is possible to simulate a shape with high accuracy, which is to be abraded by the CMP and so forth, to correctly obtain an abrasion rate, and especially, it is possible to avoid a task that there is a difference in an abrasion rate between a measurement value and a simulation value in case that the density of the convex portions is low.

BRIEF DESCRIPTION OF THE INVENTION

This and other objects, features, and advantages of the present invention will become more apparent upon a reading of the following detailed description and drawings, in which:

FIG. 1A is a plan view of one small region, and FIG. 1B is a cross sectional view along line 1B—1B of FIG. 1A.

FIG. 3A is a plan view of a small region, and FIG. 3B is a cross sectional view along line 3B—3B of FIG. 3A.

DESCRIPTION OF THE EMBODIMENTS

Figure 1A:
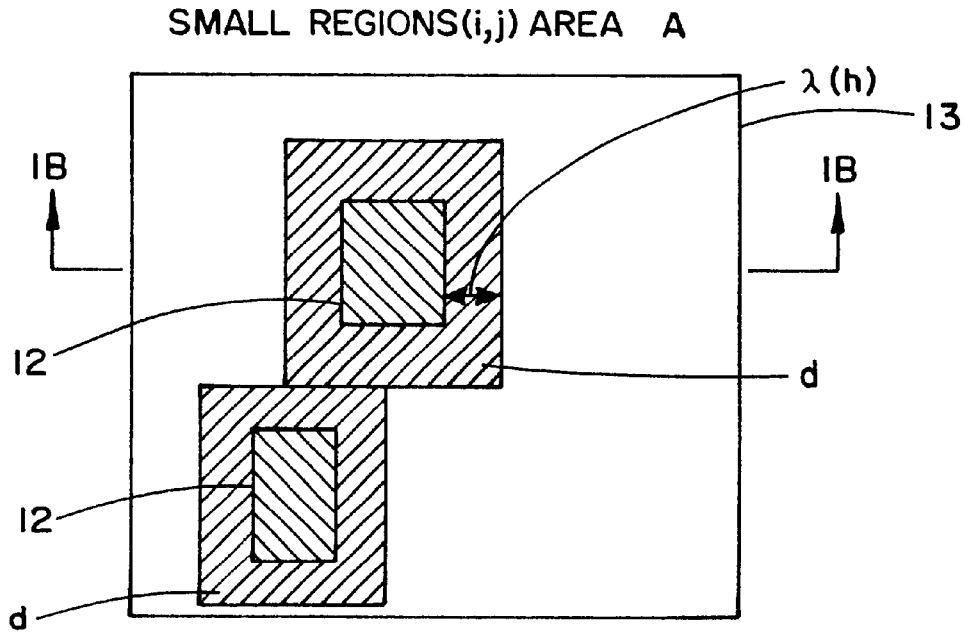
FIG. 1A and FIG. 1B are views illustratively showing an abrasion method in one embodiment of the present invention.
Figure 1B:
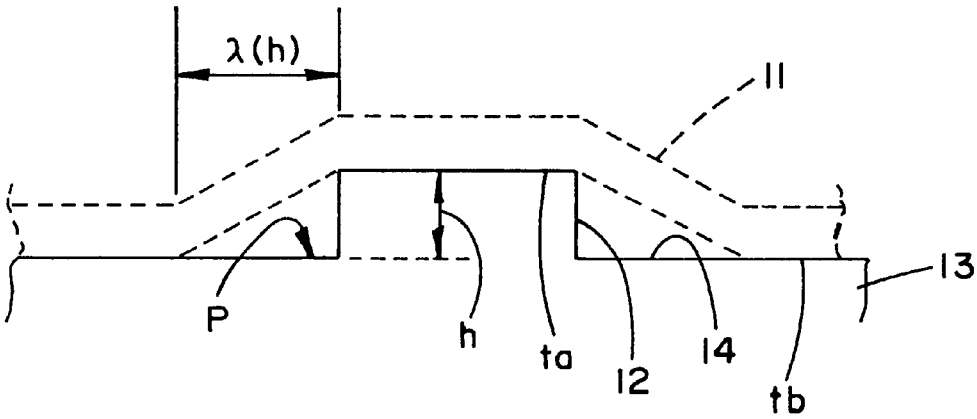

The present invention will be further explained in detail by referring to the figures. FIG. 1A and FIG. 1B are views illustratively showing an abrasion method in one embodiment of the present invention, and FIG. 1A is a plan view of one small region, and FIG. 1B is a cross sectional view of FIG. 1A.

In the abrasion method in this embodiment, abrasion is conducted with a wafer 13 sandwiched between an abrasive head (not shown) of a CMP device and an abrasive pad. As shown in FIG. 1A, in case that abrading an oxidized film having concavity and convexity on the wafer 13, a region to be simulated in a layout data of a wiring process of a semiconductor device is divided into a plurality of small regions (i,j), and an area thereof is assumed to be A.

As shown in FIG. 1B, average height from a wafer surface of each convex pattern 12 formed on the wafer 13 is assumed to be h, a sum total of areas of tip surfaces of each convex pattern 12 in the small regions (i,j) is assumed to be B, and a surrounding region within a distance λ(h) around the convex pattern is assumed to be P. ta indicates a contact part with a tip surface of the convex pattern 12 in the abrasive pad 11, and tb indicates a part where the abrasive pad 11 is in contact with a concave pattern 14 in case that density (=B/A) of the convex patterns 12 is low. Furthermore, a sum total of an area of the surrounding region P in the small regions (i,j) is assumed to be C.

Figure 2:
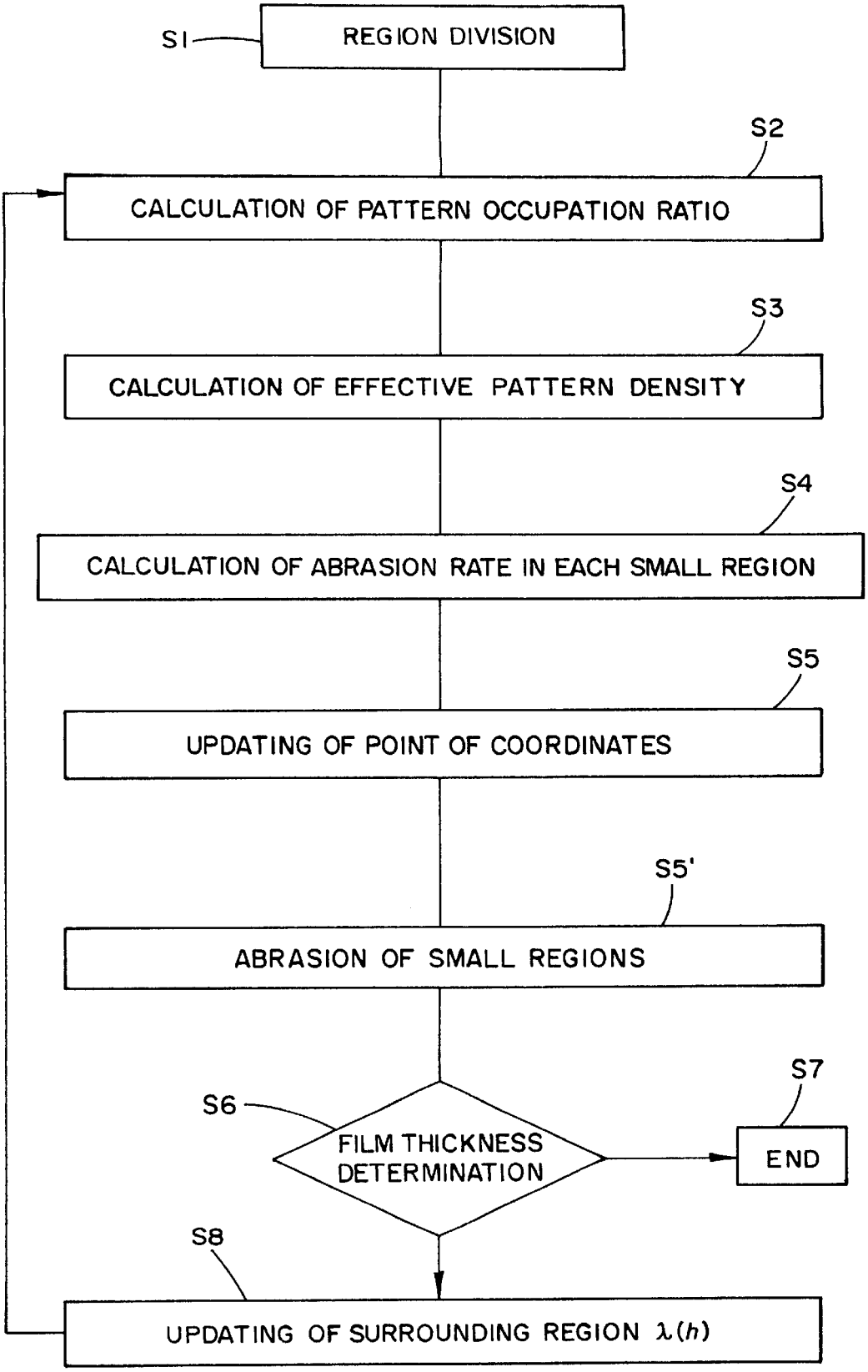
FIG. 2 is a flowchart showing an abrasion method in this embodiment.
Figure 3A:
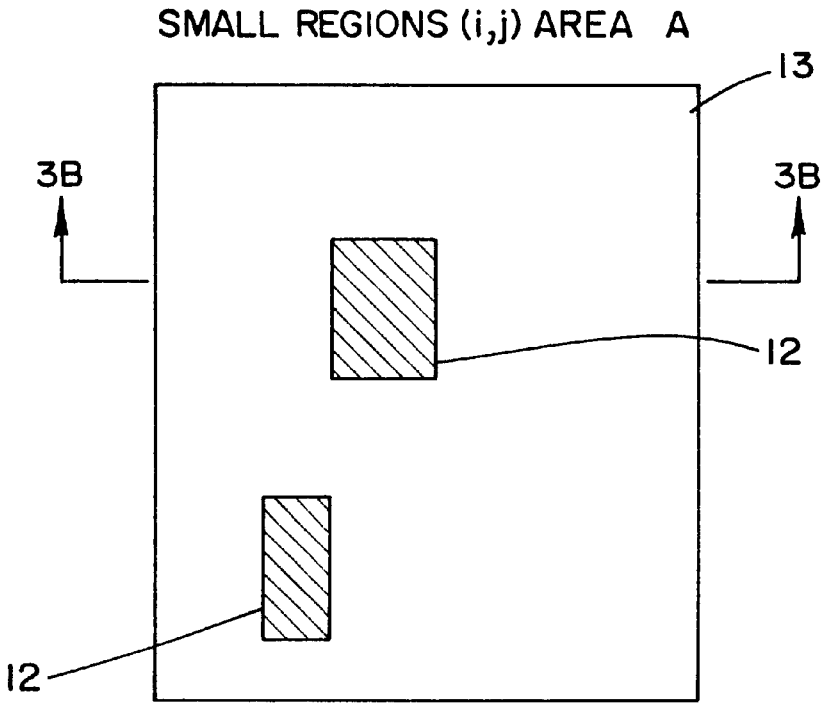
FIG. 3A PRIOR ART
FIG. 3A and FIG. 3B are views illustratively showing a conventional abrasion method.
Figure 3B:
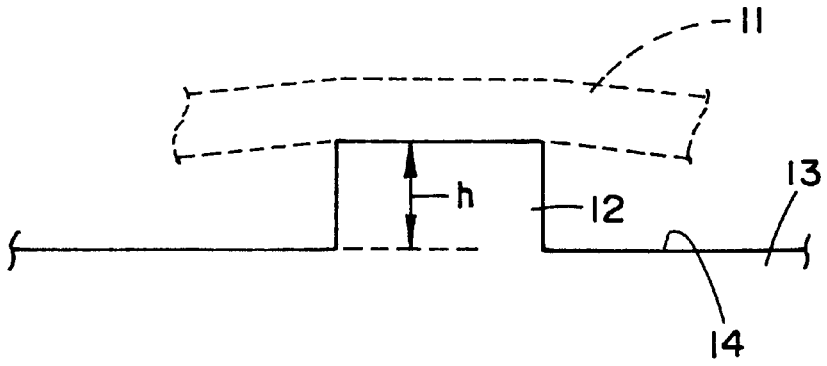
FIG. 3B PRIOR ART

FIG. 2 is a flowchart showing an abrasion method in this embodiment. First, in a step S1, a distribution of steps of an oxidized film on the wafer 13 is previously calculated from the layout data on the assumption that it is equivalent to steps of each wiring pattern located in a lower layer of the oxidized film, and a region to be simulated within the semiconductor device is divided into a plurality of small regions having a predetermined area A, respectively. Here, an arbitrary small region (i,j) will be studied.

In a step S2, for respective convex patterns 12 in the small region (i,j), a surrounding region P within a distance λ(h) from each side surface of the convex patterns 12 when the abrasive pad 11 comes into contact therewith is estimated, and an occupation ratio of the convex patterns 12 is calculated. Here, a surrounding of each convex pattern 12 is enlarged, and by means of clipping (determination of the inside and the outside), an overlapping part of the respective enlarged convex patterns 12 is removed. The surrounding region P is a region between a root part of the convex pattern 12 and a contact part tb between the abrasive pad 11 in the surrounding of this root part and the wafer 13, and here, the calculation is conducted by assuming the distance λ(h) in the initial surrounding region P (at calculation time 0) as about 200–800 μm.

In a step S3, an area A of the small region (i,j), a sum total B of areas of tip surfaces of the convex patterns 12 in the small region (i,j), and a sum total C of an area of the surrounding region P in the small region (i,j) are calculated, respectively. In this case, calculation is conducted by using a model which is created on the assumption that whole stress applied to the surrounding region P from the abrasive pad 11 acts on the convex patterns 12, and does not act on the concave patterns 14. This model is based on a result that stress concentration is difficult to occur at a part where the abrasive pad 11 is in contact with the concave pattern 14 on the wafer 13. Here, effective density D(i,j) of the concave pattern is calculated by the following equation (1):

$$D(i,j)=A/(A+C) \quad (1).$$

In a step S4, each abrasion rate in the small region (i,j) is calculated. Here, assuming that approximate average height H(i,j) of the abrasive pad 11 from a wafer surface is given as an average of the sum total B of the areas of the tip surfaces of the convex patterns having average height h(i,j) and the sum total C of the area of a bottom part of the step (the concave pattern 14), the approximate average height H(i,j) is calculated by the following equation (2):

$$H(i,j)=h(i,j)\cdot B/(B+C) \quad (2).$$

Next, assuming that an abrasion rate R(i,j) in the small region (i,j) is proportional to a difference between the approximate height H(i,j) in the small region (i,j) and the approximate height H(i,j) in the surrounding small regions, the abrasion rate R(i,j) is obtained. Here, a gradient G(i,j) of the abrasive pad 11 in the surrounding region P is given by an equation (3), $$G(i,j)=1+k\{4H(i,j)-H(i+1,j)-H(i-1,j)-H(i,j+1)-H(i,j-1)\} \quad (3)$$

and when a proportional constant is assumed to be R0, the abrasion rate R(i,j) is given by a Preston equation, the following equation (4):

$$R(i,j)=R0\cdot G(i,j)/D(i,j) \quad (4).$$

In the Preston equation, for example, when average height of the convex patterns is assumed to be T, a movement distance of the abrasive pad is assumed to be s, a load which acts on the convex patterns is assumed to be L, an area of the small region is assumed to be M, a proportional constant is assumed to be q, and a time period of abrasion is assumed to be t, a relationship of the following equation is established:

$$DT/dt=q(L/M)(ds/dt).$$

Accordingly, R0 is given as follows:

$$R0=q(L/A)(ds/dt)$$

In a step S5, since the shape of the convex patterns 12 which are abraded is changed as time passes, coordinates h(i,j) of the height of the convex patterns 12 in the small region (i,j) are updated by using the obtained abrasion rate R(i,j). In this time, a distance λ(h) of the surrounding region P is obtained as a function of h(i,j) as follows:

Here, a bend of the abrasive pad 11 is assumed to be flection h at a point of a length x(=λ). Assuming that a bending moment is Mx(=−wx2/2), an elastic constant is E, and a cross section quadric moment is Iz, by means of an equation of a bend:

$$d^4y/dx^4=-Mx/(EIz),$$

a uniform distribution load w is applied, and when the equation is solved as y=0, $dy/dx$, that is, $y'=0$, $x=\lambda$, $y=h$, and $y=0$ at $x=0$, a relationship between λ and h becomes to be the following equation (5):

$$\lambda(h)=Kh(i,j)^{1/4} \quad (5).$$

K is given by the following equation (6):

$$K=w/8EIz \quad (6).$$

In a step S6, film thickness of the abraded oxidized film is determined, and if it becomes to be required film thickness, the process is ended (step S7). On the other hand, if it does not becomes to be the required film thickness, at a step S8, after the distance λ(h) of the surrounding region P, which successively changes since the convex patterns 12 become low, is updated, steps after the step S2 are repeated.

In the abrasion method of this embodiment, since the model is used, in which it is considered that, in case that the convex pattern density is low, the stress applied to the surrounding region P concentrates on only the convex patterns 12, it is possible to simulate the concave and convex shape on the wafer 13 with high accuracy, and to correctly calculate an abrasion rate even in case that the convex pattern density is low. Also, since determination of superposition by means of clipping and a solution method of a difference equation are used for a calculation part which requires time, it is possible to realize high accurate calculation while suppressing the increase of calculation time. By means of application of the present invention, compared with the prior art, it is possible to reduce an error of an abrasion rate between a calculation value and an actual value by about 30%.

In this embodiment, although the abrasion rate is obtained by the equations (2) to (4), instead of this, coordinates of the concavity and convexity of an oxidized film surface on the wafer 13 are calculated based on the height h(i,j) of each convex pattern 12 in the small region (i,j), and a movement rate R(i,j) of the abrasive pad 11 is obtained based on a stress analysis in which the abrasive pad 11 is pressed against the oxidized film surface, and a value of coordinates of the above-described concavity and convexity. In this case, assuming that the abrasion rate R(i,j) is proportional to a stress value ox(i,j) in a direction vertical to the wafer 13, which is obtained in the stress analysis, the abrasion rate R(i,j) is obtained by using the Preston equation. Thereby, the concave and convex shape can be calculated with higher accuracy.

Although, as mentioned above, the present invention was explained based on the preferable embodiment thereof, the abrasion method of the semiconductor device of the present invention is not limited to only arrangements of the above-described embodiments, and an abrasion method of a semiconductor device, in which various modifications and changes are applied to the arrangements of the above-described embodiments, is contained in the scope of the present invention.

As explained above, according to the abrasion method of the semiconductor device of the present invention, even in case that the density of the convex portions on the semiconductor substrate is low, an abrasion accuracy can be improved by setting an appropriate abrasion rate.

What is claimed is:

1. An abrasion method of a semiconductor device, in which concavity and convexity of an oxidized film surface on a semiconductor substrate are abraded using an abrasive pad, characterized in that the method comprises steps of:

dividing a region to be simulated in a layout data of a wiring process of said semiconductor device into a plurality of small regions;

calculating approximate average height of said abrasive pad from concave portions in said small regions based on a sum total of tip surfaces of convex portions, average height of said convex portions, and a sum total of the area of a surrounding region around each convex portion; and abrading said plurality of small regions using said calculated average height of said abrasive pad.

2. An abrasion method of a semiconductor device according to claim 1, wherein, when the sum total of areas of tip surfaces of said convex portions is B, the average height of said convex portions is h(i,j), and the sum total of an area of said surrounding region is C, the approximate average height H(i,j) of said abrasive pad in said small regions (i,j) within said plurality of small regions is obtained by the following equation:

$$H(i,j)=h(i,j)\cdot B/(B+C).$$

3. An abrasion method of a semiconductor device according to claim 2, wherein, when a proportional constant is k, a gradient G(i,j) of said abrasive pad in said surrounding region is obtained by the following equation:

$$G(i,j)=1+k\{4H(i,j)-H(i+1,j)-H(i-1,j)-H(i,j+1)-H(i,j-1)\}.$$

4. An abrasion method of a semiconductor device according to claim 3, wherein, when an area of said small regions (i,j) is A, and a proportional constant is R0, effective density D(i,j) of said convex portions, and a movement rate R(i,j) of said abrasive pad are obtained by the following equations, respectively:

$$D(i,j)=A/(A+C),$$

and $$R(i,j)=R0\cdot G(i,j)/D(i,j).$$

5. An abrasion method of a semiconductor device, in which concavity and convexity of an oxidized film surface on a semiconductor substrate are abraded using an abrasive pad, characterized in that the method comprises the steps of:

dividing a region to be simulated in a layout data of a wiring process of said semiconductor device into a plurality of small regions;

calculating approximate average height of said abrasive pad from concave portions in said small regions based on a sum total of areas of tip surfaces of convex portions, average height of said convex portions, and a sum total of the area of a surrounding region around each convex portion, and abrading said plurality of small regions using said calculated average height of said abrasive pad, wherein, when the sum total of areas of tip surfaces of said convex portions is B, the average height of said convex portions is h(i,j), and the sum total of the area of said surrounding region is C, the approximate average height H(i,j) of said abrasive pad in said small regions (i,j) within said plurality of small regions is obtained by the following equation:

$$H(i,j)=h(i,j)\cdot B/(B+C).$$

6. An abrasion method of a semiconductor device according to claim 5, wherein, when a proportional constant is k, a gradient G(i,j) of said abrasive pad in said surrounding region is obtained by the following equation:

$$G(i,j)=1+k\{4H(i,j)-H(i+1,j)-H(i-1,j)-H(i,j+1)-H(i,j-1)\}.$$

7. An abrasion method of a semiconductor device according to claim 6, wherein, when an area of said small regions (i,j) is A, and a proportional constant is R0, effective density D(i,j) of said convex portions, and a movement rate R(i,j) of said abrasive pad are obtained by the following equations, respectively:

$$D(i,j)=A/(A+C),$$

and $$R(i,j)=R0\cdot G(i,j)/D(i,j).$$

8. An abrasion method of a semiconductor device, in which concavity and convexity of an oxidized film surface on a semiconductor substrate are abraded using an abrasive pad, characterized in that the method comprises the steps of:

dividing a region to be simulated in a layout data of a wiring process of said semiconductor device into a plurality of small regions;

calculating coordinates of the concavity and convexity of said oxidized film surface based on average height of each convex portion in said small region;

obtaining a movement rate of said abrasive pad based on a stress analysis which is conducted by pressing said abrasive pad against said oxidized film surface, and a value of coordinates of said concavity and convexity, and abrading said plurality of small regions using said calculated coordinates of the concavity and convexity of said oxidized film surface based on average height of each convex portion in said small region and said movement rate of said abrasive pad based on a stress analysis which is conducted by pressing said abrasive pad against said oxidized film surface, and a value of coordinates of said concavity and convexity.

* * * * *